US006409384B1

(12) United States Patent
Provan et al.

(10) Patent No.: US 6,409,384 B1
(45) Date of Patent: Jun. 25, 2002

(54) ZIPPER SLIDER WITH GRAB TAB

(75) Inventors: Alexander R. Provan, Canandaigua; Thomas L. Coomber, Palmyra; Toby R. Thomas, Victor, all of NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/636,195

(22) Filed: Aug. 10, 2000

(51) Int. Cl.[7] ..... B65D 33/34

(52) U.S. Cl. ..... 383/5; 24/429; 24/431; 383/61; 383/64; 383/204

(58) Field of Search ..... 383/5, 64, 204, 383/209, 61; 24/429, 399, 400, 431

(56) References Cited

U.S. PATENT DOCUMENTS

| | | | | | |
|---|---|---|---|---|---|
| 1,703,712 | A | * | 2/1929 | Aud | 24/429 |
| 2,358,653 | A | * | 9/1944 | Mock | 383/64 |
| 2,514,750 | A | * | 7/1950 | Dobbs et al. | 383/64 |
| 2,756,172 | A | * | 7/1956 | Kidd | 24/429 |
| 2,777,181 | A | * | 1/1957 | Morner | 24/429 |
| 2,960,561 | A | * | 11/1960 | Plummer | 24/429 |
| 5,007,142 | A | | 4/1991 | Herrington | 24/400 |
| 5,010,627 | A | | 4/1991 | Herrington et al. | 24/400 |
| 5,020,194 | A | | 6/1991 | Herrington et al. | 24/400 |
| 5,063,644 | A | | 11/1991 | Herrington et al. | 24/400 |
| 5,067,208 | A | | 11/1991 | Herrington, Jr. et al. | 24/400 |
| 5,070,583 | A | | 12/1991 | Herrington | 24/400 |
| 5,077,064 | A | * | 12/1991 | Hustad et al. | 383/5 |
| 5,189,764 | A | | 3/1993 | Herrington et al. | 24/387 |
| 5,224,779 | A | * | 7/1993 | Thompson et al. | 383/5 |
| 5,283,932 | A | | 2/1994 | Richardson et al. | 24/400 |
| 5,301,394 | A | | 4/1994 | Richardson et al. | 24/399 |
| 5,301,395 | A | | 4/1994 | Richardson et al. | 24/400 |
| 5,426,830 | A | | 6/1995 | Richardson et al. | 24/430 |
| 5,431,760 | A | | 7/1995 | Donovan | 156/66 |
| 5,442,837 | A | | 8/1995 | Morgan | 24/400 |
| 5,442,838 | A | | 8/1995 | Richardson et al. | 24/402 |
| 5,448,808 | A | | 9/1995 | Gross | 24/400 |
| 5,456,928 | A | * | 10/1995 | Hustad et al. | 383/5 |
| 5,669,715 | A | | 9/1997 | Dobreski et al. | 383/5 |
| 5,713,669 | A | | 2/1998 | Thomas et al. | 383/204 |
| 5,775,812 | A | | 7/1998 | St. Phillips et al. | 383/5 |
| 5,867,875 | A | | 2/1999 | Beck et al. | 24/400 |
| 5,896,627 | A | | 4/1999 | Cappel et al. | 24/400 |
| 5,924,795 | A | * | 7/1999 | Thompson et al. | 383/5 |
| 6,009,602 | A | * | 1/2000 | Terada | 24/429 |
| 6,036,364 | A | * | 3/2000 | Heuvel | 383/64 |

FOREIGN PATENT DOCUMENTS

| | | | | |
|---|---|---|---|---|
| FR | 2636923 | * | 3/1990 | 383/64 |

* cited by examiner

*Primary Examiner*—Stephen P. Garbe
(74) *Attorney, Agent, or Firm*—Jenkens & Gilchrist

(57) ABSTRACT

A reclosable plastic bag comprises first and second opposing body panels, a zipper, a slider, and a grab tab. The opposing body panels are joined to each other along a pair of sides and a bottom bridging the pair of sides. The zipper extends along a mouth formed opposite the bottom. The slider is slidably mounted to the zipper for movement between a closed position and an open position. Movement of the slider is effectuated using a grab tab extending upward from the slider. In one embodiment, first and second upstanding panels extend upwardly from the respective first and second body panels and form a pocket containing the zipper and the slider. The grab tab on the slider extends upwardly toward or above an upper end of the pocket so as to be easily graspable.

13 Claims, 3 Drawing Sheets

Fig. 1
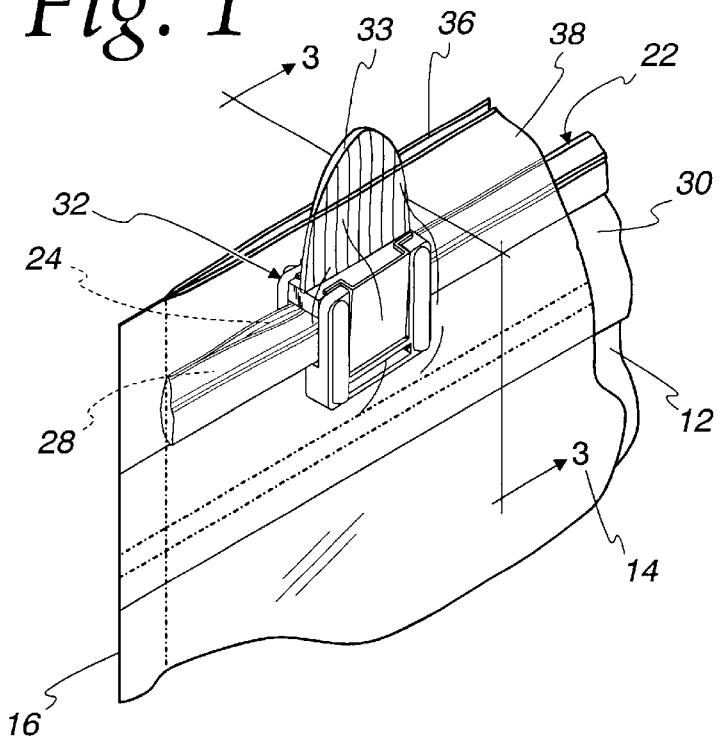
Fig. 3
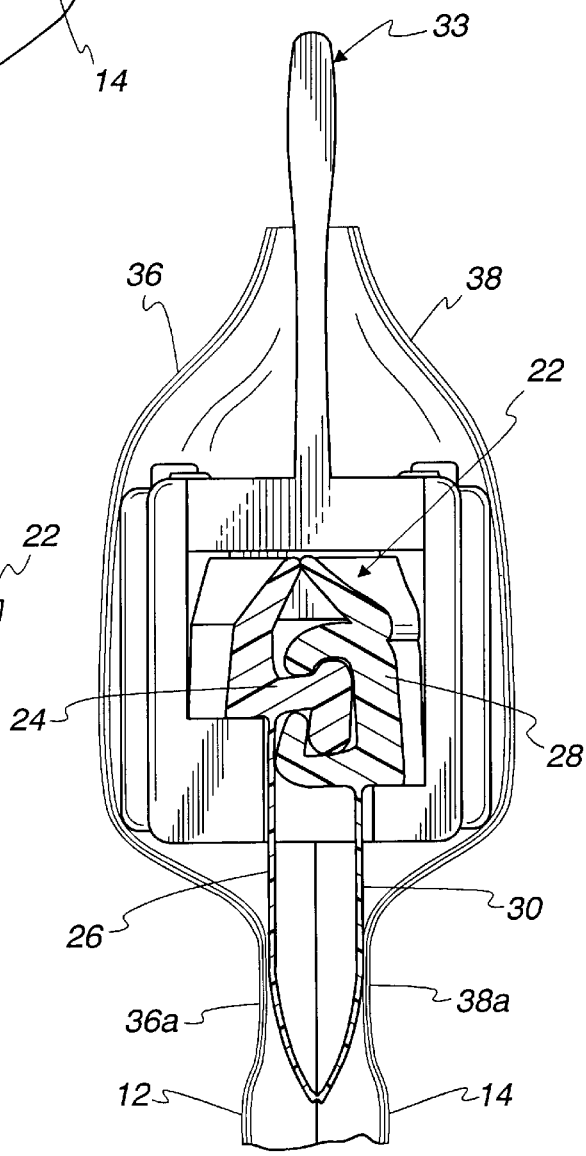
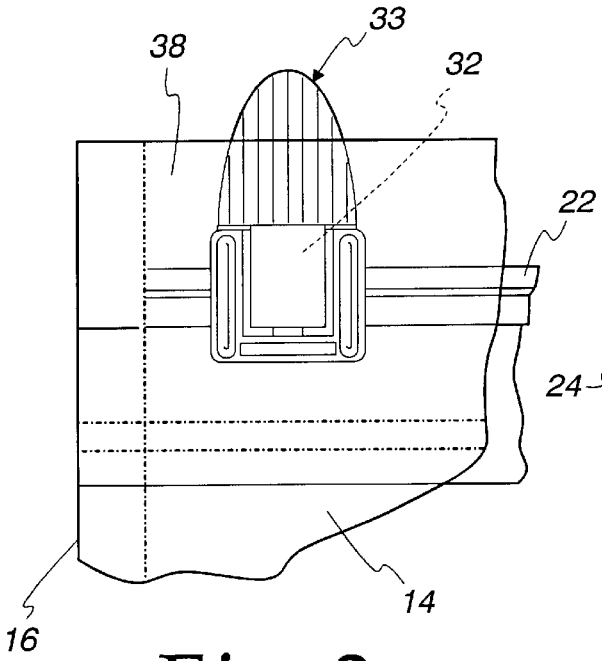
Fig. 2

Fig. 4
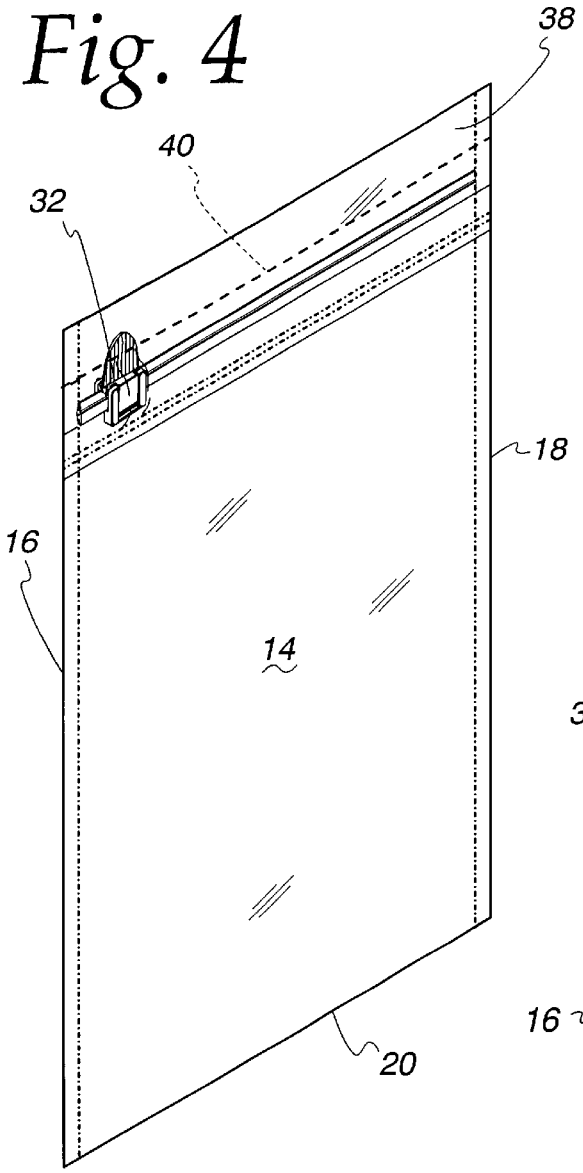
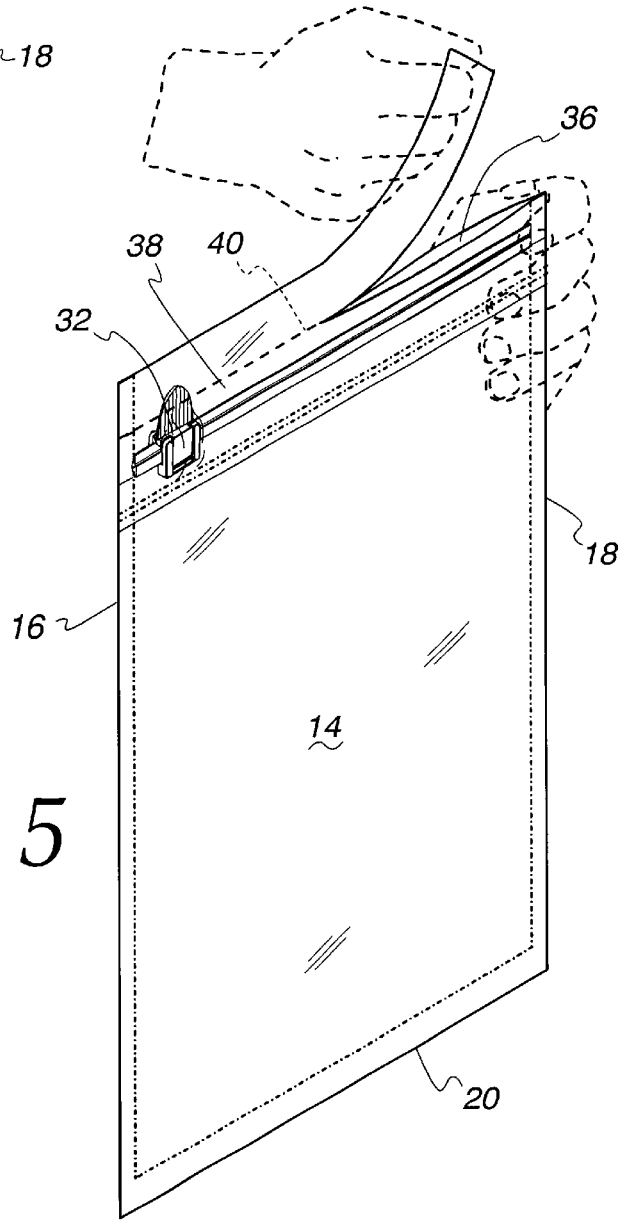
Fig. 5

ZIPPER SLIDER WITH GRAB TAB

FIELD OF THE INVENTION

The present invention generally relates to reclosable plastic bags and, more particularly, to a reclosable plastic bag including a zipper slider having a grab tab that allows consumers to easily grasp the zipper slider when opening and closing the bag.

BACKGROUND OF THE INVENTION

A reclosable plastic bag typically includes first and second opposing panels joined to each other along a pair of sides and a bottom bridging the pair of sides. The first and second panels are not joined along a mouth which is formed opposite to the sealed bottom. Rather, the bag is provided with a reclosable zipper extending along the mouth of the plastic bag. The zipper includes a male track and a female track. In reclosable plastic bags of the type disclosed in U.S. Pat. No. 5,067,208 utilizing a slider to open the zipper, the male track typically includes a male profile and a first fin extending downward from the male profile. Likewise, the female track in such bags with sliders includes a female profile and a second fin extending downward from the female profile. The first and second fins are thermally fused to or integrally formed with the respective first and second panels.

The male and female tracks are typically free of any plastic material above the male and female profiles in order to permit proper mounting and movement of the slider. The male and female profiles are releasably engageable to each other. When the slider is in a closed position, the male and female profiles are interlocked with each other. In response to moving the slider to an open position, the male and female profiles are disengaged from each other. Once the male and female profiles are disengaged from each other, access to the interior of the bag may be obtained by pulling the first and second panels apart at the mouth.

Reclosable plastic bags of the foregoing type are a great convenience to the consumer especially for products such as deli meat, cheese, snacks and cereal where, typically, only a portion of the product is used at any given time. A problem with these reclosable bags, however, is that if such plastic bags are to be prepackaged with a food product and then sold in a grocery store, the contents of the plastic bags can easily be tampered with prior to purchase by the consumer. Therefore it is desirable to provide such prepackaged bags with some sort of tamper-evident feature. One such tamper-evident feature has taken the form of a top enclosure that encapsulates the zipper. Such enclosures are disclosed in U.S. Pat. No. 5,713,669 to Thomas et al., which is incorporated by reference herein in its entirety. The consumer tears the enclosure above the zipper to gain access to the zipper and the package contents. However, consumers may find it somewhat difficult to access and grip the slider when it is buried within the top enclosure. Therefore, it is desirable to have an easier means of grasping the slider.

SUMMARY OF THE INVENTION

A reclosable plastic bag includes first and second opposing body panels joined to each other along a pair of sides and a bottom bridging the pair of sides. The bag is provided with a reclosable zipper extending along a mouth formed opposite the sealed bottom of the plastic bag.

A slider is slidably mounted to the zipper for movement between a closed position and an open position. The slider has a grab tab, which makes it easier to grasp and move the slider. The male and female profiles are engaged to each other while the slider is in the closed position. The male and female profiles are disengaged from each other in response to movement of the slider to the open position.

In one embodiment, first and second upstanding panels extend upwardly from the respective first and second body panels and form a pocket containing the zipper and the slider. The grab tab on the slider extends upwardly toward an upper end of the pocket or outside of the pocket so as to be easily graspable.

In another embodiment, the first and second upstanding panels may be joined above the zipper and slider to form a tamper evident enclosure. In this embodiment, the tamper evident enclosure is torn or peeled off by the user, and the user may then access the grab tab to move the slider. In this embodiment, the grab tab may remain inside the pocket formed by the first and second upstanding panels or it may extend above the pocket.

DESCRIPTION OF THE DRAWINGS

Other objects and advantages of the invention will become apparent upon reading the following detailed description and upon reference to the drawings in which:

FIG. 1 is an isometric view of a mouth portion of a reclosable plastic bag showing a slider with a grab tab captured within a pocket;

FIG. 2 is a front view of the bag mouth portion in FIG. 1;

FIG. 3 is a sectional view taken generally along the line 3—3 in FIG. 1;

FIG. 4 is an isometric view of the reclosable plastic bag showing the slider and grab tab captured within a sealed pocket;

FIG. 5 is an isometric view of the reclosable plastic bag in FIG. 4 showing the seal on the pocket in the process of being broken;

Figure 6:
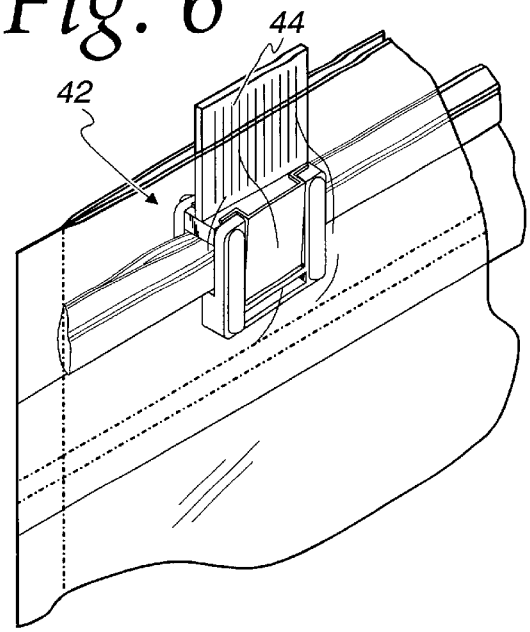
FIG. 6 is an isometric view of an alternative embodiment for a slider and grab tab.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings, FIGS. 1–3 depict a mouth portion of a reclosable plastic bag embodying the present invention. The plastic bag comprises first and second opposing body panels 12 and 14 joined to each other along a pair of sides 16 and 18 (see FIGS. 4 and 5) and a bottom 20 (see FIGS. 4 and 5) bridging the pair of sides 16 and 18. The bottom 20 may be a single folded panel, separate panels sealed together, a gusset made from one piece of material, or a gusset made from separate panels sealed together. The bag is provided with a reclosable zipper 22 extending along the mouth portion, which is formed opposite the sealed bottom 20 of the plastic bag.

The zipper 22 includes a male track and a female track. The male track includes a male profile 24 and a first depending fin or flange 26 extending downward from the male profile 24. Likewise, the female track includes a female profile 28 and a second depending fin or flange 30 extending downward from the female profile 28. If the zipper 22 is formed separately from the body panels 12 and 14 of the bag, the first and second fins 26 and 30 are thermally fused to inner surfaces of the respective first and second body panels 12 and 14. Alternatively, the zipper 22 may be extruded with the panels 12 and 14 such that the first fin 26 is integrally formed with the first body panel 12 and the second fin 30 is integrally formed with the second body panel 14.

To assist in opening and closing the plastic bag, a slider 32 is slidably mounted to the zipper 22 for movement between a closed position and an open position. In the closed position of the slider 32, the male and female profiles 24 and 28 are interlocked with each other. Movement of the slider 32 from the closed position toward the open position disengages the male and female profiles 24 and 28 from each other and allows a user to gain access to the interior of the plastic bag. Further details concerning the construction and operation of the zipper 22 and slider 32 may be obtained from U.S. Pat. No. 5,067,208 to Herrington, Jr. et al., which is incorporated herein in its entirety by reference.

First and second upstanding panels 36 and 38 extend upwardly from the respective first and second body panels 12 and 14. The first upstanding panel 36 is integrally formed with or thermally fused to the first body panel 12. FIG. 3 shows a lowermost strip 36*a* of the first upstanding panel 36 integrally formed with an uppermost strip of the first body panel 12. Likewise, the second upstanding panel 38 is integrally formed with or thermally fused to the second body panel 14. FIG. 3 shows a lowermost strip 38*a* of the second upstanding panel 38 integrally formed with an uppermost strip of the second body panel 14. One piece is "integrally formed" with another piece when both pieces are made of the same piece of material.

In a preferred embodiment, the first upstanding panel 36 is integrally formed with the first body panel 12 from the same piece of material and the second upstanding panel 38 is integrally formed with the second body panel 14 from the same piece of material. The first and second upstanding panels 36 and 38 may alternatively be formed from pieces of material separate from the respective first and second body panels 12 and 14.

Each of the upstanding panels 36 and 38 includes opposing vertical ends in line with the sides 16 and 18, and the opposing vertical ends of the first upstanding panel 36 are thermally fused to the respective opposing vertical ends of the second upstanding panel 38 along the sides 16 and 18 to form a pocket in which the slider 32 and zipper 22 are captured. The pocket prevents the slider 32 from going past the ends of the zipper 22 and provides adequate end strength that resists stresses applied to the profiles 24 and 28 during normal use of the bag.

Referring now to FIGS. 4 and 5, if the plastic bag is used to prepackage food products such as deli meat, cheese, snacks and cereal which are later sold in a grocery store, it is desirable to provide the plastic bag with a tamper-evident feature. The first and second upstanding panels 36 and 38 are ideally suited for this purpose. To minimize tampering with the plastic bag, upper edges of the respective first and second upstanding panels 36 and 38 are joined to each other to seal the pocket and completely encapsulate the slider 32 and zipper 22 within the sealed pocket. The upper edges of the respective first and second upstanding panels 36 and 38 may be joined to each other either by thermal fusion or by integrally forming these upper edges with each other. When the upper edges are integrally formed with each other, the first and second upstanding panels are created from a single folded piece of film where the fold is disposed along the upper edges and the slider 32 and zipper 22 are effectively located in the area of the fold.

To permit a consumer to gain access to the interior of the plastic bag when the pocket is sealed for tamper-evident purposes, the sealed pocket is preferably provided with a one-time breakable seal. If the consumer purchases a prepackaged plastic bag with the one-time breakable seal intact, it is highly unlikely that the contents of the plastic bag have been tampered with because the zipper 22 cannot easily be opened without breaking the seal. Even if the zipper 22 could be opened without breaking the seal, access to the interior of the plastic bag via the opened zipper 22 is difficult because the zipper 22 is still encapsulated in the sealed pocket. If, on the other hand, the consumer purchases a plastic bag with the one-time breakable seal broken, then it is more likely that the contents of the plastic bag have been tampered with.

The one-time breakable seal for restricting access to the slider 32 and zipper 22 may take several forms. For example, as shown in FIG. 4, the upstanding panels 36 and 38 may include respective parallel lines of weakness 40 extending between the sides 16 and 18 of the bag and oriented generally parallel to the zipper 22. The lines of weakness 40 may be perforated lines, score lines, or thinned/die lines with less plastic extruded along the lines. To break such a one-time breakable seal, a consumer tears away upper portions of the upstanding panels 36 and 38 along the lines of weakness 40 as shown in FIG. 5. The upstanding panels 36 and 38 may be thermally fused to each other above the lines of weakness 40 to facilitate grasping and subsequent tearing of the upstanding panels 36 and 38. In another embodiment, a single line of weakness is formed at the juncture of the uppermost edges of the upstanding panels 36 and 38.

In yet another embodiment, the one-time breakable seal takes the form of a peelable seal. To create the peelable seal, the inner surfaces of one or both of the upstanding panels 36 and 38 above the slider 32 and zipper 22 are detachably connected to each other by a tacky adhesive-like substance that is well-known in the art.

In a further embodiment, the first and second upstanding panels 36 and 38 are joined to each other and no line of weakness is formed along or at the juncture of the panels. In this embodiment, the consumer gains entrance into the sealed pocket formed by the joined panels 36 and 38 by cutting off upper portions of the upstanding panels 36 and 38 with a cutting device such as a scissors, knife, or the like.

A grab tab 33 extends upward from the slider 32 to enable a user to more easily grasp the grab tab 33 and thereby slide the slider along the zipper 22. In the absence of a grab tab 33, a user must reach into the pocket surrounding the slider 32 in order to (grasp and move the slider. This can be somewhat difficult because the upstanding panels 36 and 38 block easy access to the body of the slider 32, and the user must simultaneously separate the upstanding panels 36 and 38 from the slider, grasp the slider, and move the slider. In contrast, the grab tab allows the user to easily move the slider without needing to separate the upstanding panels 36 and 38. The grab tab 33 may be provided with ridges that reduce the chance that a user's fingers will slip off the grab tab 33, making it easier to grasp. Further, the grab tab 33 may be curved to more closely fit the curvature of a user's fingertips. In an alternative embodiment the slider 32 extends upwardly beyond the first and second upstanding panels 36 and 38 to allow easier grasping by a user.

Figure 7:
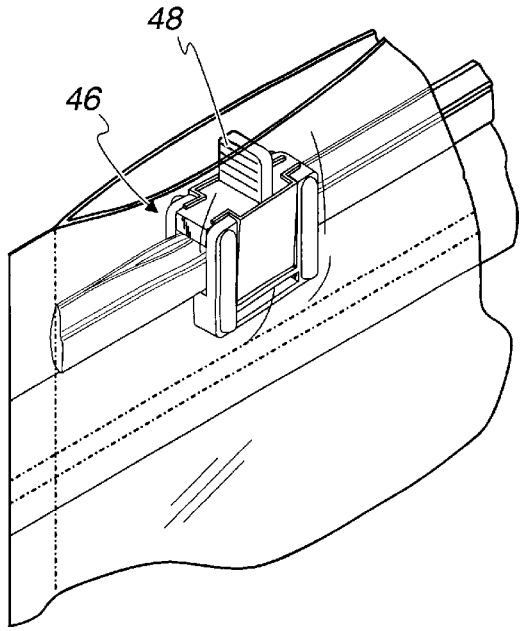
FIG. 7 is an isometric view of a second alternative embodiment for a slider and grab tab.

FIGS. 6 through 9 display alternative embodiments for a grab tab for use in the present invention. FIG. 6 shows a slider 42 having a rectangular grab tab 44 which extends above the surrounding pocket. FIG. 7 shows a slider 46 having a transverse grab tab 48. The grab tab 48, which is transverse to the direction of slider movement, allows for easy gripping by a consumer even if the transverse grab tab 48 does not extend above the surrounding pocket. Such a grab tab could be used, for example, where the tamper-evident feature is a peelable seal. A grab tab extending above the surrounding pocket would not allow for the use of a peelable seal as a tamper-evident feature because the grab tab would interfere with the seal.

Figure 8:
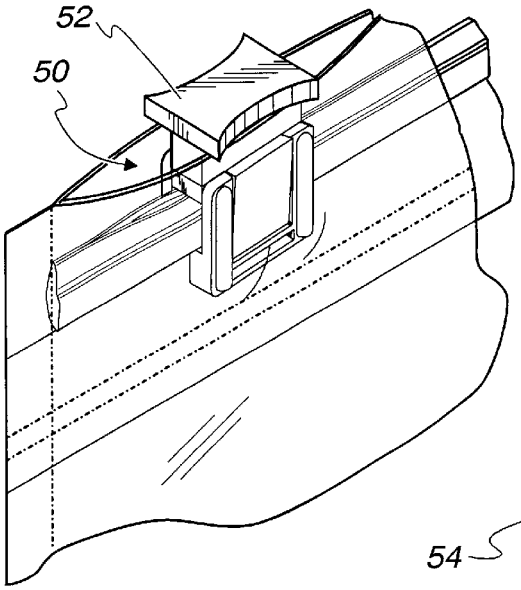
FIG. 8 is an isometric view of a third alternative embodiment for a slider and grab tab.
Figure 9:
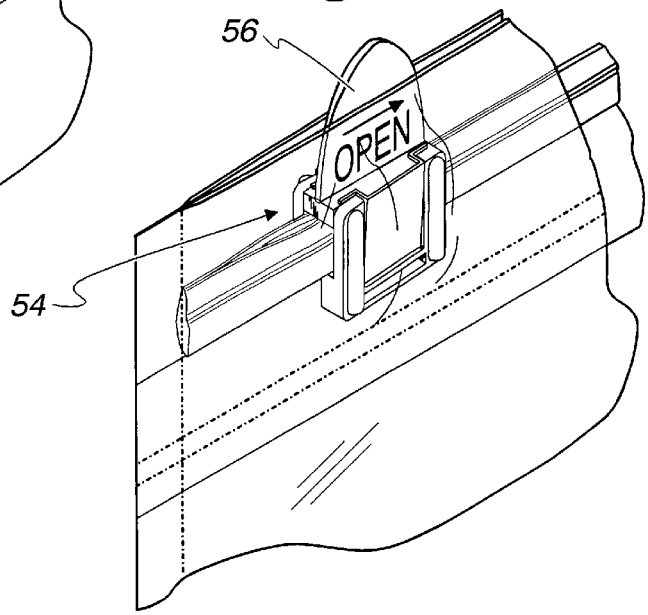
FIG. 9 is an isometric view of a fourth alternative embodiment for a slider and grab tab.

FIG. 8 shows a slider 50 having an hourglass-shaped grab tab 52. An hourglass-shaped grab tab 52 allows for ergonomic grasping by a customer because a customer's fingers can easily fit into the contours on each side of the hourglass. The lower surface of the grab tab 52 rides along the upper edges of the upstanding panels that form the open pocket. FIG. 9 shows a slider 54 having a semi-elliptical grab tab 56 with a display to show the consumer which way to slide the slider 54 when opening the bag.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable plastic bag, comprising:

first and second opposing body panels joined to each other along a pair of sides and a bottom bridging said pair of sides;

a zipper extending along a mouth formed opposite said bottom;

a slider slidably mounted to said zipper for opening and closing said zipper;

a grab tab extending upward from said slider and adapted to be grasped by a user for effectuating movement of said slider along said zipper;

first and second upstanding panels extending upwardly from respective said first and second body panels and being joined to each other to encapsulate said slider and said grab tab in a pocket, said first and second upstanding panels including one or more breakable lines of weakness for gaining access into said pocket, said grab tab extending above one or more of said breakable lines of weakness.

2. The reclosable plastic bag of claim 1 wherein said breakable lines of weakness are generally linear.

3. The reclosable plastic bag of claim 1 wherein said grab tab includes one or more contours adapted to ease grasping by a user.

4. The reclosable plastic bag of claim 1 wherein said grab tab is rectangular.

5. The reclosable plastic bag of claim 1 wherein said grab tab is semi-elliptical.

6. The reclosable plastic bag of claim 1 wherein said breakable lines of weakness are perforated lines.

7. The slider structure of claim 1 wherein said first and second lines of weakness are score lines.

8. The slider structure of claim 1 wherein said first and second lines of weakness are thinned lines.

9. A reclosable plastic bag, comprising:

first and second opposing body panels joined to each other along a pair of sides and a bottom bridging said pair of sides;

a zipper extending along a mouth formed opposite said bottom;

a slider slidably mounted to said zipper for opening and closing said zipper;

a grab tab extending upward from said slider and adapted to be grasped by a user for effectuating movement of said slider along said zipper; and first and second upstanding panels extending upwardly from respective said first and second body panels, each of said first and second upstanding panels including opposing ends, the opposing ends of said first upstanding panel being connected to the respective opposing ends of said second upstanding panel to form a pocket in which said slider is captured, said first and second upstanding panels being integrally formed with respective ones of said first and second body panels.

10. The reclosable plastic bag of claim 9 wherein said grab tab is transverse to a direction of slider movement.

11. The reclosable plastic bag of claim 9 wherein said grab tab is hourglass-shaped.

12. A method of accessing the contents of a bag having a zipper with a slider and upstanding panels extending upwardly from said zipper, comprising:

removing upper portions of said upstanding panels to form an open pocket;

grasping above said open pocket a grab tab extending upwardly from said slider; and moving said grab tab to open said zipper.

13. The method of claim 12 wherein removing said upper portions of said upstanding panels comprises tearing off said upper portions along pre-formed lines of weakness.

* * * * *